US006035545A

United States Patent [19]

Jones

[11] Patent Number: 6,035,545

[45] Date of Patent: Mar. 14, 2000

[54] DRYING BOX FOR SMALL TWO AND THREE DIMENSIONAL ARTICLES

[76] Inventor: K. C. Jones, 150 Storywood, San Antonio, Tex. 78213

[21] Appl. No.: 09/075,305

[22] Filed: May 8, 1998

[51] Int. Cl.[7] ..... F26B 19/00

[52] U.S. Cl. ..... 34/202

[58] Field of Search ..... 34/90, 103, 104, 34/106, 107, 201, 202, 218, 219, 223; 223/51, 70, 73, 76; D32/58, 59; 392/382, 385

[56] References Cited

U.S. PATENT DOCUMENTS

| | | | |
|---|---|---|---|
| 1,688,793 | 10/1928 | Schrenkeisen . | |
| 2,260,687 | 10/1941 | Lasha | 34/202 |
| 3,475,828 | 11/1969 | Feldman et al. | 34/22 |
| 4,158,262 | 6/1979 | Grasso | 34/202 |
| 4,385,239 | 5/1983 | Miller | 250/492.3 |
| 4,733,480 | 3/1988 | Hutchins | 34/104 |
| 4,750,276 | 6/1988 | Smith et al. | 34/225 X |
| 5,014,446 | 5/1991 | Reesman | 34/151 |
| 5,249,369 | 10/1993 | Mallet | 34/104 X |
| 5,289,642 | 3/1994 | Sloan | 34/104 |
| 5,378,525 | 1/1995 | Raynor | 34/104 |
| 5,388,344 | 2/1995 | Wallach | 34/91 |
| 5,443,538 | 8/1995 | Little | 34/91 |
| 5,592,750 | 1/1997 | Eichten | 34/104 |
| 5,606,640 | 2/1997 | Murphy | 392/382 |
| 5,776,378 | 7/1998 | Knight | 34/202 X |

*Primary Examiner*—Stephen Gravini
*Attorney, Agent, or Firm*—Baker Botts L.L.P.

[57] ABSTRACT

A dryer box for quickly drying coated surfaces of small articles, such as paint sample cards. The dryer box has a sleeve that receives a conventional dryer gun. A vertical air channel directs air to a first drying location at the bottom of the box especially designed for placement of a small three dimensional article. A horizontal air channel directs air to a second drying location on an inner side wall of the box especially designed for attachment of a two dimensional article. The same inner side wall is used as a door for access to both drying locations.

18 Claims, 3 Drawing Sheets

DRYING BOX FOR SMALL TWO AND THREE DIMENSIONAL ARTICLES

TECHNICAL FIELD OF THE INVENTION

This invention relates to dryers, and more particularly to a device for drying a surface of a small article, such as a paint sample on a piece of cardboard.

BACKGROUND OF THE INVENTION

A review of the prior art reveals a variety of compartments especially designed for receiving an air flow and for containing articles to be dried. These devices include compartments for drying objects such as clothing, newly painted fingernails, shoes, gas masks, and towels.

A particular need exists for a dryer especially designed to dry paint samples. In retail paint stores, it is a common practice for a salesperson to paint a small surface with a color sample for a customer. The salesperson then holds the sample while waving it in the air to dry it or dries it with a hand-held "gun" type hair dryer. The drying process is an inefficient use of time.

SUMMARY OF THE INVENTION

One aspect of the invention is a dryer box for quickly drying coated surfaces of small articles, such as paint sample cards. In one embodiment, the dryer box has a rectangular housing, into whose interior one or more articles to be dried are placed. A sleeve at the top of the dryer box receives a conventional dryer gun. A vertical air channel directs air from the dryer gun to a first drying location at the bottom of the box especially designed for drying a small three dimensional article. A horizontal air channel, which extends from an opening in the vertical air channel, directs air to a second drying location on an inner side wall of the box especially designed for drying a two dimensional article. The same inner side wall is used as a door for access to both drying locations.

An advantage of the invention is that it is useful for drying small surface areas that are now being dried by hand, that is, by waving them in the air. For example, in retail paint stores, paint samples are dried by salespersons in this manner, which is an inefficient use of their time. The drying box is convenient for drying either two dimensional articles, such as paint sample cards, or three dimensional articles, such as a piece or molding or trim or the like.

DETAILED DESCRIPTION OF THE INVENTION

Figure 1:
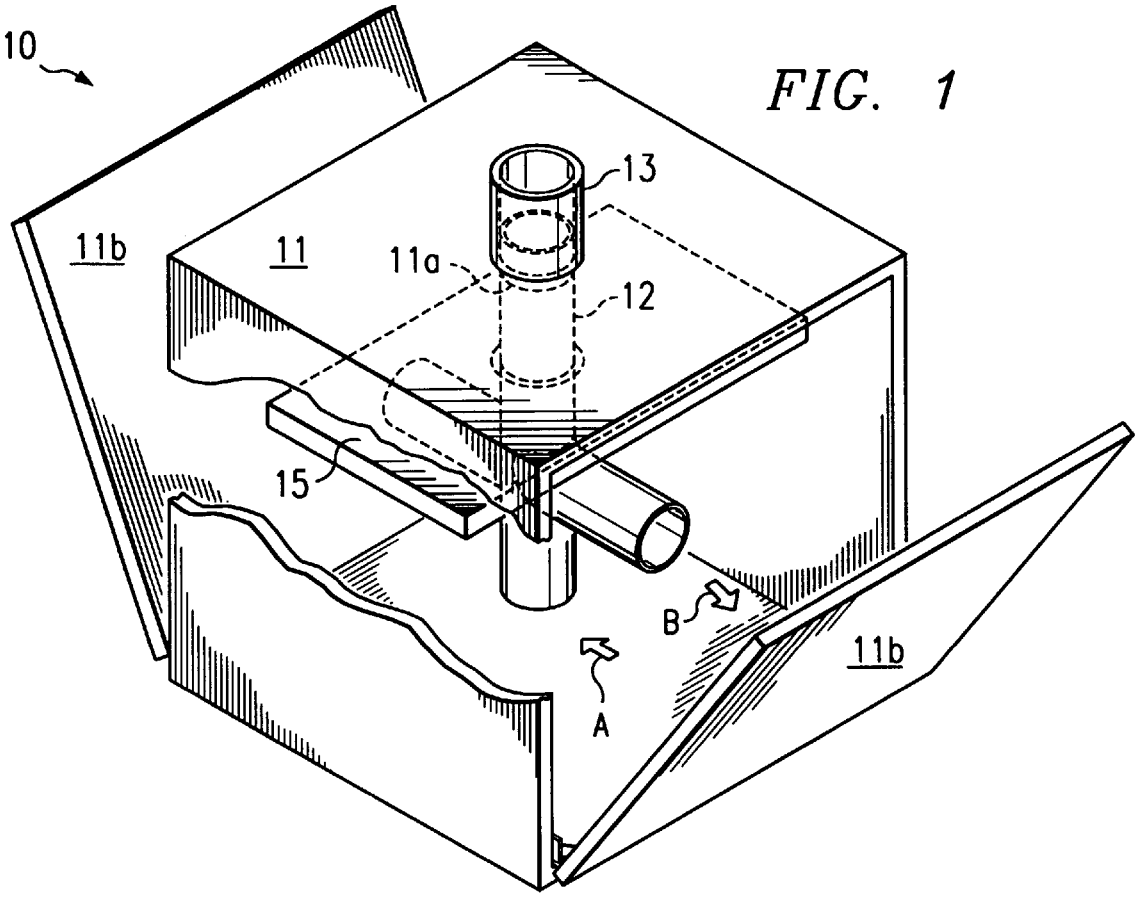
FIG. 1 is a perspective view of a dryer box in accordance with the invention.

FIG. 1 is a perspective view of a dryer box 10 in accordance with the invention. Dryer box 10 is designed for use on a countertop such as a countertop of a retail paint store. Therefore, box 10 is small, lightweight, and portable. A typical size of box 10 might be approximately one cubic foot. Box 10 is especially suited for drying a partial surface area of a small article. It has a drying location for three dimensional articles (Location A), as well as a drying location for two dimensional articles (Location B). Examples of such articles are a small piece of wood or a paper card, respectively, which has a part of its surface coated with a sample of wet paint.

A housing 11 is substantially rectangular in shape. Other shapes may be used, but in general, housing 11 has a closed hollow form and has a flat bottom surface and at least one flat interior vertical surface.

The walls of housing 11 may be any material that is thin, lightweight, heat resistant, and substantially airtight. In the preferred embodiment, housing 11 is made from plastic laminate. This material has been experimentally determined to provide optimum drying conditions inside housing 11.

At least one side of housing 11 has a door 11*b*, which provides access to the interior of housing 11. During operation, the article to be dried is either attached to the inside surface of door 11*b* or placed on the inside bottom surface of housing 11, depending on whether the article is two dimensional or three dimensional.

In the example of this description, door 11*b* is hinged at the bottom. However, in other embodiments, door 11*b* could be hinged at the side or top. Other means for opening and closing door 11*b*, could be used.

In the embodiment of FIG. 1, two walls of housing 11 are hinged such that opposing walls of housing 11 form two doors 11*b*. In other embodiments, two doors 11*b* could be in two adjacent walls. It is also possible that more than two walls could have doors 11*b*. As explained below, each door 11*b* has an associated horizontal air channel 14, which directs air during the drying process to a drying location on the inside surface of the door 11*b*.

An aperture 11*a* in the top of housing 11 permits a vertical air channel 12 to extend upwardly out of box 10. Vertical air channel 12 has an outer diameter only slightly smaller than the circumference of aperture 11*a* so that the fit is snug and there is little or no release of air from the box 10 during operation. If desired, some sort of airtight seal may be used.

The end of vertical air channel 11 that extends out from the top of box 10 may be designed to receive a sleeve 13, which in turn, receives the nozzle of a conventional dryer gun. Such dryer guns, also known as "blow dryers", are commercially available and commonly used for drying hair. Typically, such dryer guns have a round nozzle, and the receiving end of sleeve 13 is circular. Sleeve 13 may have a different circumference at each of its ends, so that the nozzle of the dryer gun need not have the same circumference as vertical air channel 12. Sleeve 13 may be removable so that different sleeves 13 having differently sized receiving ends may be used, thereby accommodating different nozzle sizes. It is also possible that sleeve 13 could be made adjustable to accept different nozzle sizes. For example, a sleeve 13 made from a flexible plastic or rubber could be expected to accommodate a reasonable range of nozzle sizes. In still other embodiments, the end of the vertical air channel 12 may be designed to receive the nozzle directly without use of a sleeve 13.

Inside box 10, vertical air channel 12 extends downwardly toward the bottom surface of box 10. In operation, air from the dryer gun flows from an output end of vertical air channel and is focussed to a relatively small area on the bottom of box 10. A feature of the invention is that it is designed for quick drying of relatively small flat articles. Thus, the distance between the output end of air channel 12 and the bottom inside surface of box 10 is small, typically in the range of 2–3 inches.

Vertical air channel 12 joins a horizontal air channel 14 that is entirely inside housing 11. Horizontal air channel 14 is substantially perpendicular to vertical air channel 12. It extends from vertical air channel 12 to distance proximate to the inside surface of door 11*b*. The distance from the output end of horizontal air channel 14 to the inside surface of door 11*b* is such that a small two dimensional article having a wet surface, such as a newly painted piece of cardboard, may be quickly dried when placed on the inside surface of door 11*b*. A typical distance from the output end of horizontal air channel to the inside surface of door 11*b* is in the range of 1–2 inches. This distance has been experimentally determined to focus air from the dryer onto an area of suitable size and with suitable heat and force. Optimum drying conditions for the flat surface are provided, such that drying occurs quickly without disrupting the wet surface by the force of the air during drying. For a box 10 having two doors 11*b*, this distance may be different for each door 11*b* to accommodate different types of media or paint.

As stated above, box 10 may have more than one hinged door 11*b*, as is the case with the embodiment of FIG. 1. Each door 11*b* has an associated horizontal air channel 14 and thus an associated drying location for two dimensional articles.

A brace 15 extends the full length or width (or both) of the interior of housing 11. It stabilizes vertical air channel 12 inside housing 11. Other stabilizing means could be used, such as brackets or struts. Although not shown in FIG. 1, baffles could be used to enhance drying conditions inside housing 11. It is possible that brace 15, or some other type of stabilizing means, could be designed to provide stabilization for vertical air channel 12 as well as to serve as an air baffle.

Figure 2:
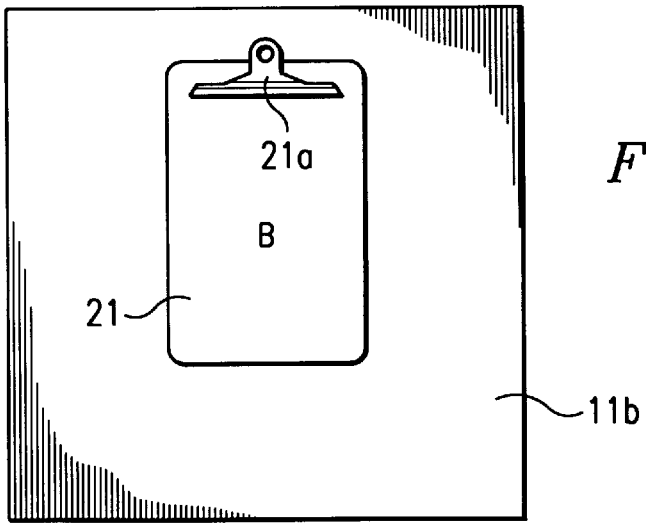
FIG. 2 illustrates the interior surface of a door of the dryer box.
Figure 3:
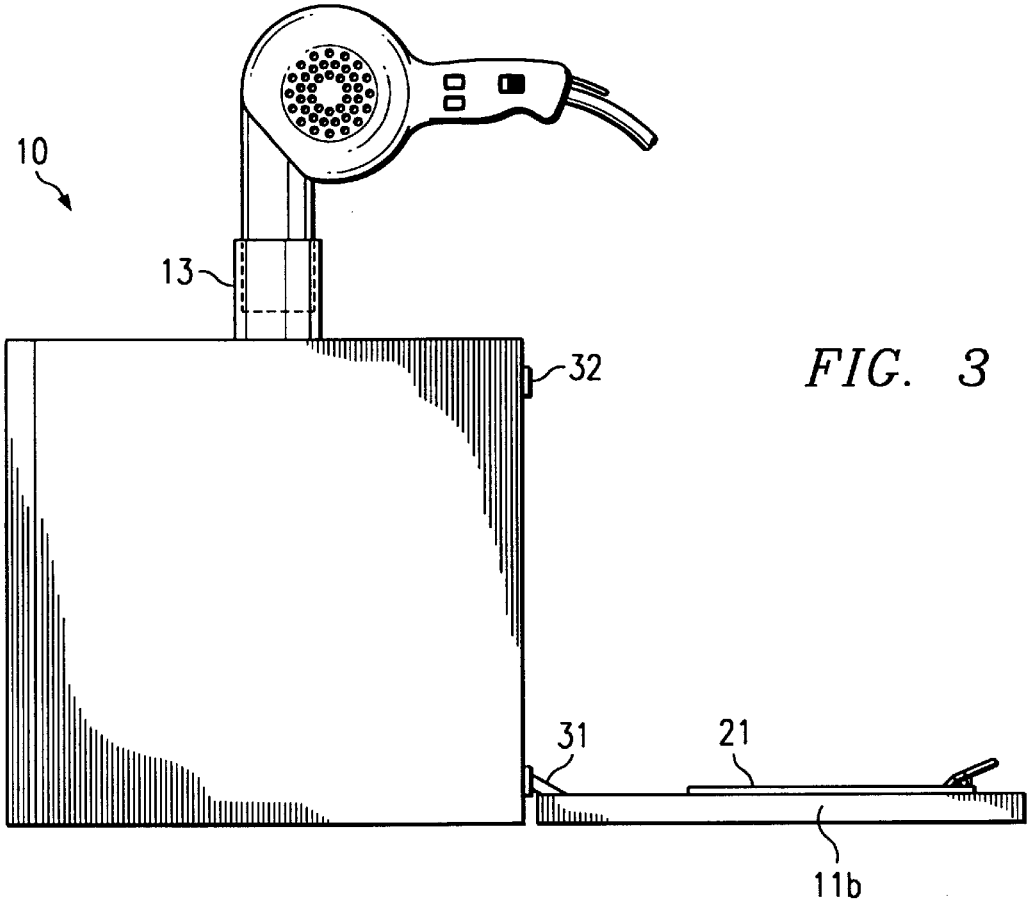
FIG. 3 is a side view of the door.

FIG. 2 illustrates the inside surface of door 11*b* and an example of a means for attaching the two dimensional article ("the coated media") during the drying process. In the embodiment of FIG. 2, the attachment means is a small clipboard 21. A spring-type clip 21*a* is manipulated such that it holds the coated media in place. Clipboard 21 is attached to the inside of door 11*b* such that when a typically sized media is placed in the clip 21*a*, the drying location B corresponds to the spot on the media where paint is most likely to be applied, i.e., the center of the media. FIG. 3 illustrates door 11*b* in a fully opened position. As illustrated, hinges 31 permit door 11*b* to lie flat against the surface upon which box 10 is placed. This "drop-down" design of door 11*b* provides for convenient, one-handed insertion of the article to be dried. In the example of FIG. 3, hinge 31 is spring loaded and holds the top of door 11*b* against housing 11 when door 11*b* is closed. Other means for holding door 11*b* in a closed position could be used, such as magnetic or latching means at the top of door 11*b* and at the corresponding location on housing 11.

Spacers 32 may be used to provide a small air gap between door 11*b* and housing 11 when door 11*b* is closed. In the example of this description, this gap is 3/32 inches. A slight amount of ventilation has been experimentally determined to enhance drying conditions. Other ventilation techniques could be used such as perforations in housing 11.

FIG. 3 further illustrates a typical gun dryer having its nozzle inserted into sleeve 13. The fit of the nozzle into sleeve 13 is such that the dryer gun is securely positioned as illustrated, without additional holding mechanism. Once the article(s) to be dried have been placed in box 10 and the door(s) 11*b* closed, an on/off switch on the dryer gun is all that is needed to operate the invention.

Referring again to the embodiment of FIG. 1, where box 10 has two doors 11*a* and two horizontal air channels 14, aperture 11*a* is substantially in the middle of the top of housing 11, such that vertical air channel 12 extends downwardly toward the middle of the inside bottom surface. However, in other embodiments, vertical air channel 12 could be placed closer to one door 11*a* than the other. For example, for samples attached to one door 11*b* vis a vis the other door 11*b*. Also, for a box 11 having only one door 11*b*, vertical air channel 12 could be extend down nearer to one side of housing 11 rather than extending down the middle.

Figure 4:
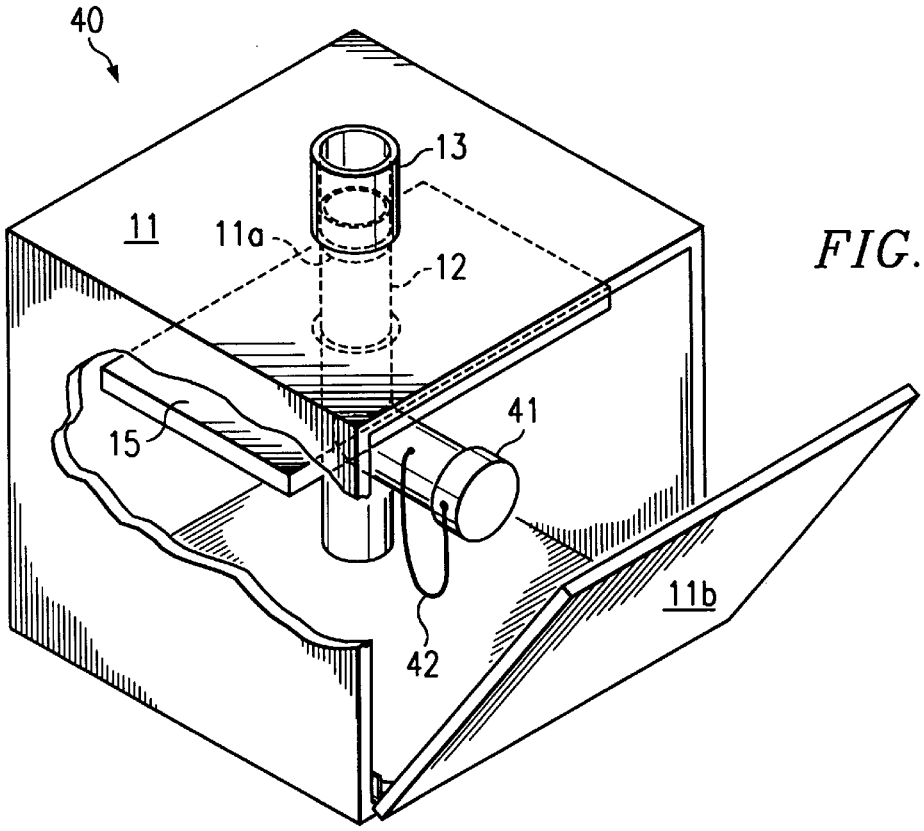
FIG. 4 is an alternative embodiment of the invention.

FIG. 4 is an alternative embodiment of the invention, a dryer box 40 having only one door 11*b*. FIG. 4 also illustrates how a cap 41 may be placed over an end of horizontal air channel 14. Cap 41 is removable, so that air from horizontal air channel 14 may be blocked as desired. For example, if maximum drying power were desired at the drying location B on the bottom surface of box 10, cap 41 might be placed on channel 14. Cap 41 is attached within housing 11 to avoid its being misplaced, such as by means of a small chain 42. Although not shown in FIG. 2, a similar removable cap 41 could be associated with the output end of vertical channel 12.

Cap(s) 41 on the ends of the vertical or horizontal air channels 12 and 14 permit the drying at a particular drying location to be controlled. For example, for drying a media painted with oil-based paint at location B, less heat might be desired than if the media were painted with water-based paint. In this case, cap 41 would not be placed on vertical air channel 12. Air would be directed out of both channels 12 and 14, resulting in less hot air at location B.

Figure 5:
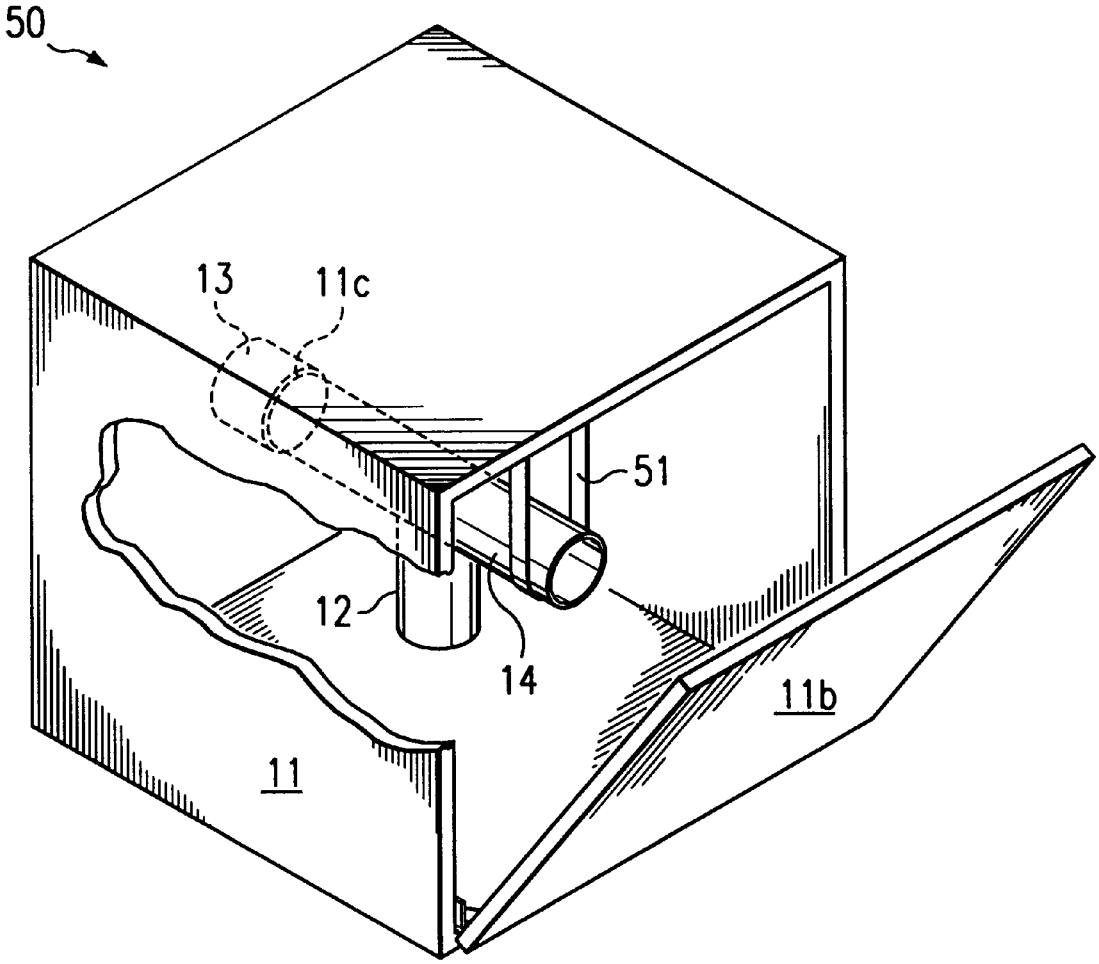
FIG. 5 is another alternative embodiment of the invention.

FIG. 5 is a third embodiment of the invention, a dryer box 50 having sleeve 13 attached to the horizontal air channel 14 rather than to the vertical air channel 12. Housing 11 has an aperture 11*c* for receiving the horizontal air channel 14. Thus, aperture 11*c* is in a side wall rather than a top wall of housing 11. Some sort of support 51 may be used to stabilize horizontal air channel 14.

In the embodiment of FIG. 5, where aperture 11*c* is in a side wall, there could be two vertical air channels. It is easy to see how a second vertical air channel could extend upwardly from vertical air channel 12. A door 11*b* would in the top wall of box 50 would provide access to the interior of housing 11 and a means for attaching the two-dimensional sample. This second vertical air channel could be used instead of, or in addition to, horizontal air channel 14.

Other Embodiments

Although the present invention has been described in detail, it should be understood that various changes, substitutions, and alterations can be made hereto without departing from the spirit and scope of the invention as defined by the appended claims.

What is claimed is:

1. A dryer box for drying a surface of a small article, using forced air from an air blower, comprising:

a housing having a substantially flat bottom element, and having at least one side having a door for access to the interior of said housing, and having an aperture in a top element operable to receive air from the air blower;

a vertical air channel operable to receive the forced air from said aperture and extending downwardly from said aperture to a point above the inside surface of said bottom element, such that an output end of said vertical air channel focusses the air to a first drying location on said inside surface of said bottom element;

at least one horizontal air channel having a first end that joins said vertical air channel, said horizontal air channel being substantially perpendicular to said vertical air channel such that an output end of said horizontal air channel focusses said air to a second drying location on the inside surface of said door; and means for attaching a two dimensional article to the inside surface of said door proximate to said second end of said horizontal air channel.

2. The dryer box of claim 1, wherein said housing is substantially rectangular in shape.

3. The dryer box of claim 1, wherein said housing is substantially made from a plastic laminate.

4. The dryer box of claim 1, wherein the air blower is a dryer gun, and further comprising a sleeve extending from said housing for receiving the dryer.

5. The dryer box of claim 1, wherein said door is formed by hinging said wall.

6. The dryer box of claim 1, wherein said box has a first and second horizontal air channel, and a second door for providing a third drying location on the inside of said second door.

7. The dryer box of claim 6, wherein said first and second horizontal air channel are in line with each other, such that said second door is opposite said first door.

8. The dryer box of claim 1, further comprising means for covering the output end of at least one of said air channels.

9. The dryer box of claim 1, wherein said means for attaching is a clip attached to said inside surface of said door.

10. The dryer box of claim 1, wherein said door operates by means of a hinge.

11. The dryer box of claim 10, wherein said hinge is at the bottom of said door.

12. A dryer box for drying a surface of a small article, using forced air from an air blower, comprising:

a housing having a substantially rectangular shape, and having a substantially flat bottom element, and having a first wall with a door for access to the interior of said housing, and having an aperture in a second wall operable to receive the forced air from the air blower, wherein said second wall is a side wall;

a first air channel operable to receive air from said aperture and extending downwardly from said aperture to a point above the inside surface of said bottom element, such that an output end of said first air channel focusses the air to a first drying location on said inside surface of said bottom element;

a second air channel having a first end that joins said first air channel, said second air channel having an output end that focusses said air to a second drying location on the inside surface of said door; and means for attaching a two dimensional article to the inside surface of said door proximate to said second end of said second air channel.

13. The dryer box of claim 12, wherein said first air channel and said second air channel are perpendicular such that said second air channel focusses air toward a vertical side wall of said housing.

14. The dryer box of claim 12, wherein said first air channel and said second air channel are in line such that said second air channel focuses air toward the top of said housing.

15. The dryer box of claim 12, wherein said housing is substantially made from a plastic laminate.

16. The dryer box of claim 12, further comprising a sleeve extending from said housing for receiving a dryer gun.

17. The dryer box of claim 12, wherein said door is formed by hinging said wall.

18. The dryer box of claim 12, wherein said box has a third air channel and a second door for providing a third drying location.

* * * * *